US009360221B2

(12) United States Patent
Butler et al.

(10) Patent No.: US 9,360,221 B2
(45) Date of Patent: Jun. 7, 2016

(54) GAS TURBINE BURNER

(71) Applicant: General Electric Company, Schenectady, NY (US)

(72) Inventors: Jesse Blair Butler, Greenville, SC (US); David Leach, Simpsonville, SC (US); Kevin Weston McMahan, Greer, SC (US); Mark Allan Hadley, Greer, SC (US); Geoffrey David Myers, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 340 days.

(21) Appl. No.: 14/081,062

(22) Filed: Nov. 15, 2013

(65) Prior Publication Data

US 2014/0123652 A1 May 8, 2014

Related U.S. Application Data

(62) Division of application No. 12/510,550, filed on Jul. 28, 2009, now abandoned.

(51) Int. Cl.

| | |
|---|---|
| ***F23C 99/00*** | (2006.01) |
| ***F23R 3/28*** | (2006.01) |
| ***F23R 3/14*** | (2006.01) |

(52) U.S. Cl.

CPC . *F23R 3/286* (2013.01); *F23R 3/14* (2013.01); *F23C 2900/07001* (2013.01); *F23D 2900/14004* (2013.01); *F23D 2900/14701* (2013.01)

(58) Field of Classification Search

CPC .. F23C 7/004; F23C 2900/07001; F23R 3/04; F23R 3/12; F23R 3/286; F23D 14/02; F23D 2000/14004; F23D 2900/14701

See application file for complete search history.

(56) References Cited

U.S. PATENT DOCUMENTS

| | | | |
|---|---|---|---|
| 5,211,004 | A | 5/1993 | Black |
| 5,259,184 | A | 11/1993 | Borkowicz et al. |

(Continued)

FOREIGN PATENT DOCUMENTS

| | | | |
|---|---|---|---|
| CN | 101196125 | A | 6/2008 |
| CN | 101278152 | A | 10/2008 |

(Continued)

OTHER PUBLICATIONS

Unofficial English translation of JP Office Action issued Mar. 11, 2014 in connection with corresponding JP Application No. 2010-165416.

(Continued)

*Primary Examiner* — Arun Goyal
(74) *Attorney, Agent, or Firm* — Dority & Manning, P.A.

(57) ABSTRACT

A gas turbine includes a compressor and at least one combustor downstream from the compressor. The combustor includes a burner having an inner shroud extending axially along at least a portion of the burner, an outer shroud radially separated from the inner shroud and extending axially along at least a portion of the burner, and a plurality of stator vanes extending radially between the inner shroud and the outer shroud. The stator vanes have an inner end proximate the inner shroud and an outer end proximate the outer shroud. The burner further includes a vortex tip at one of either the inner end or the outer end of the stator vanes. The vortex tip provides a gap between the inner end and the inner shroud or the outer end and the outer shroud, and the vortex tip includes a plurality of fuel ports. The gas turbine further includes a turbine downstream from the combustor.

10 Claims, 5 Drawing Sheets

(56) References Cited

U.S. PATENT DOCUMENTS

| | | | | |
|---|---|---|---|---|
| 5,487,274 | A * | 1/1996 | Gulati | F23D 14/02 60/725 |
| 5,613,363 | A * | 3/1997 | Joshi | F23C 7/004 239/403 |
| 6,438,961 | B2 | 8/2002 | Tuthill et al. | |
| 6,883,332 | B2 | 4/2005 | Steinthorsson et al. | |
| 7,171,813 | B2 | 2/2007 | Tanaka et al. | |
| 7,360,363 | B2 | 4/2008 | Mandai et al. | |
| 7,703,288 | B2 | 4/2010 | Rogers | |
| 8,656,699 | B2 | 2/2014 | Saito et al. | |
| 2004/0068973 | A1 | 4/2004 | Wakabayashi et al. | |
| 2008/0134685 | A1 | 6/2008 | Bunker et al. | |
| 2009/0056336 | A1 | 3/2009 | Chila et al. | |

FOREIGN PATENT DOCUMENTS

| | | | |
|---|---|---|---|
| JP | 09137919 | A | 5/1997 |
| JP | 2002333138 | A | 11/2002 |
| JP | 2003-343838 | A | 12/2003 |
| JP | 2005106411 | A | 4/2005 |
| JP | 2005283000 | A | 10/2005 |
| JP | 2005283003 | A | 10/2005 |
| JP | 2006112670 | A | 4/2006 |
| JP | 2006336997 | A | 12/2006 |
| JP | 2009052877 | A | 3/2009 |
| WO | 2009069426 | A1 | 6/2009 |

OTHER PUBLICATIONS

Translation of JP Office Action drafted on Feb. 16, 2015 in relation to corresponding JP application 2010-165416.

A. Eroglue, "Vortex Generators in Lean-Premix Combustion", Journal for Engineering for Gas Turbines and Power, pp. 41-49, Jan. 2001, vol. 123.

C. Steinbach, "Operation Experience With Alstom Power's GT10 Gas Turbine and Ultra Low NOX Combustion Control"; http://cogen.mit.edu/files/powergen.pdf.

* cited by examiner

GAS TURBINE BURNER

The present application is a divisional application of U.S. application Ser. No. 12/510,550, filed on Jul. 28, 2009, which is incorporated herein by reference in its entirety and for all purposes. Any disclaimer that may have occurred during prosecution of the above-referenced application is hereby expressly rescinded.

FIELD OF THE INVENTION

The present invention generally involves a gas turbine. More particularly, the present invention relates to a gas turbine burner that mixes fuel with a working fluid prior to combustion.

BACKGROUND OF THE INVENTION

Gas turbines are widely used in commercial operations for power generation. Gas turbines generally include a compressor at the front, one or more combustors around the middle, and a turbine at the rear. The compressor progressively compresses a working fluid and discharges the compressed working fluid to the combustors. The combustors mix the working fluid with fuel and ignite the mixture to produce combustion gases having a high temperature, pressure, and velocity. The combustion gases exit the combustors and flow to the turbine where they expand to produce work.

The combustion gases include various amounts of undesirable emissions, such as unburned hydrocarbons and various nitrogen oxide (NOx) compounds. The amount of unburned hydrocarbons and NOx compounds present in the combustion gases depends on the efficiency and temperature of the combustion. Specifically, incomplete or inefficient combustion of the fuel results in increased hydrocarbon emissions. Similarly, increased combustion temperatures result in increased NOx emissions.

Various efforts have been made to reduce the amount of hydrocarbon and NOx emissions by improving the combustion efficiency. For example, U.S. Pat. No. 5,259,184, which is incorporated here in its entirety for all purposes, describes a gas turbine burner that premixes the fuel and working fluid prior to combustion. The burner includes an annular swirler that imparts a swirling motion to the working fluid, and the swirling working fluid mixes with injected fuel to produce a more uniform, leaner fuel mixture for combustion. The more uniform, leaner fuel mixture increases combustion efficiency and reduces combustion temperature, thereby reducing hydrocarbon and NOx emissions.

U.S. Pat. No. 6,438,961, which is incorporated here in its entirety for all purposes, describes an improved gas turbine burner that mixes the fuel and working fluid prior to combustion. The burner includes turning vanes with built-in fuel passages. The turning vanes impart swirl to both the working fluid and the fuel to produce more uniform mixing of the fuel and working fluid prior to combustion.

The need exists for improved premixing of the fuel and working fluid prior to combustion to further improve combustion efficiency and reduce undesirable emissions.

BRIEF DESCRIPTION OF THE INVENTION

Aspects and advantages of the invention are set forth below in the following description, or may be obvious from the description, or may be learned through practice of the invention.

One embodiment of the present invention is a burner for use in a gas turbine. The burner includes an inner shroud extending axially along at least a portion of the burner, an outer shroud radially separated from the inner shroud and extending axially along at least a portion of the burner, and a plurality of stator vanes extending radially between the inner shroud and the outer shroud. The stator vanes have an inner end proximate the inner shroud and an outer end proximate the outer shroud. The burner further includes a vortex tip at one of either the inner end or the outer end of the stator vanes. The vortex tip provides a gap between the inner end and the inner shroud or the outer end and the outer shroud.

Another embodiment of the present invention is a gas turbine. The gas turbine includes a compressor and at least one combustor downstream from the compressor. The combustor includes a burner having an inner shroud extending axially along at least a portion of the burner, an outer shroud radially separated from the inner shroud and extending axially along at least a portion of the burner, and a plurality of stator vanes extending radially between the inner shroud and the outer shroud. The stator vanes have an inner end proximate the inner shroud and an outer end proximate the outer shroud. The burner further includes a vortex tip at one of either the inner end or the outer end of the stator vanes. The vortex tip provides a gap between the inner end and the inner shroud or the outer end and the outer shroud. The gas turbine further includes a turbine downstream from the combustor.

An alternate embodiment of the present invention is a gas turbine. The gas turbine includes a compressor and at least one combustor downstream from the compressor. The combustor includes a burner having an inner shroud extending axially along at least a portion of the burner, an outer shroud radially separated from the inner shroud and extending axially along at least a portion of the burner, and a plurality of stator vanes extending radially between the inner shroud and the outer shroud. The stator vanes have an inner end proximate the inner shroud and an outer end proximate the outer shroud. The burner further includes a vortex tip at one of either the inner end or the outer end of the stator vanes. The vortex tip provides a gap between the inner end and the inner shroud or the outer end and the outer shroud, and the vortex tip includes a plurality of fuel ports. The gas turbine further includes a turbine downstream from the combustor.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION

Figure 1:
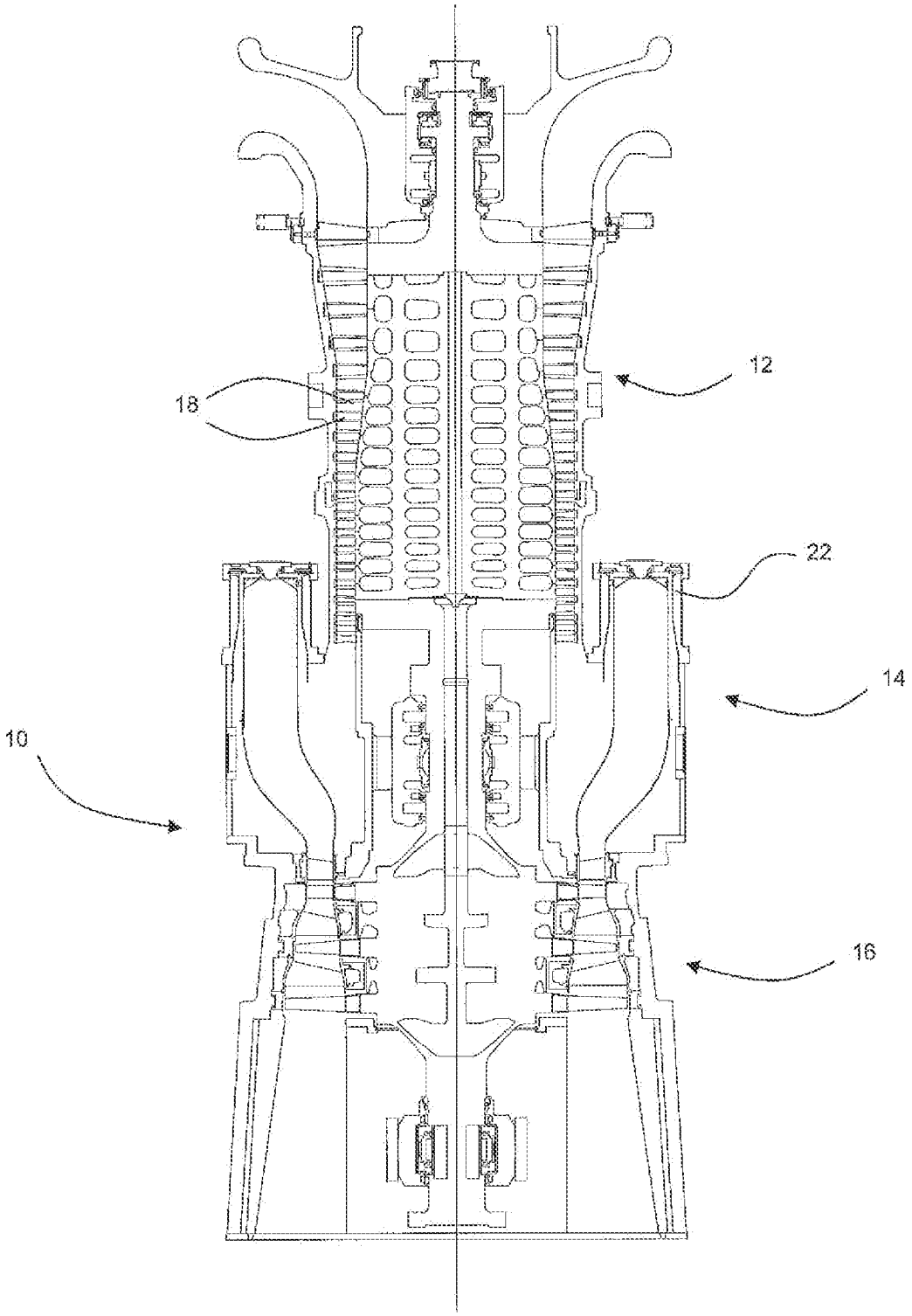
FIG. 1 is a plan drawing of an embodiment of a gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 provides an embodiment of a gas turbine 10 within the scope of the present invention. As shown in FIG. 1, the gas turbine 10 generally includes a compressor 12 at the front, one or more combustors 14 around the middle, and a turbine 16 at the rear. The compressor 12 includes multiple stages of compressor blades 18 to progressively compress a working fluid. The compressor 12 discharges the compressed working fluid to the combustors 14. Each combustor 14 includes one or more burners that mix the working fluid with fuel, and the mixture then ignites in combustion chambers 22 to produce combustion gases having a high temperature, pressure, and velocity. The combustion gases exit the combustion chambers 22 and flow to the turbine 16 where they expand to produce work.

Figure 2:
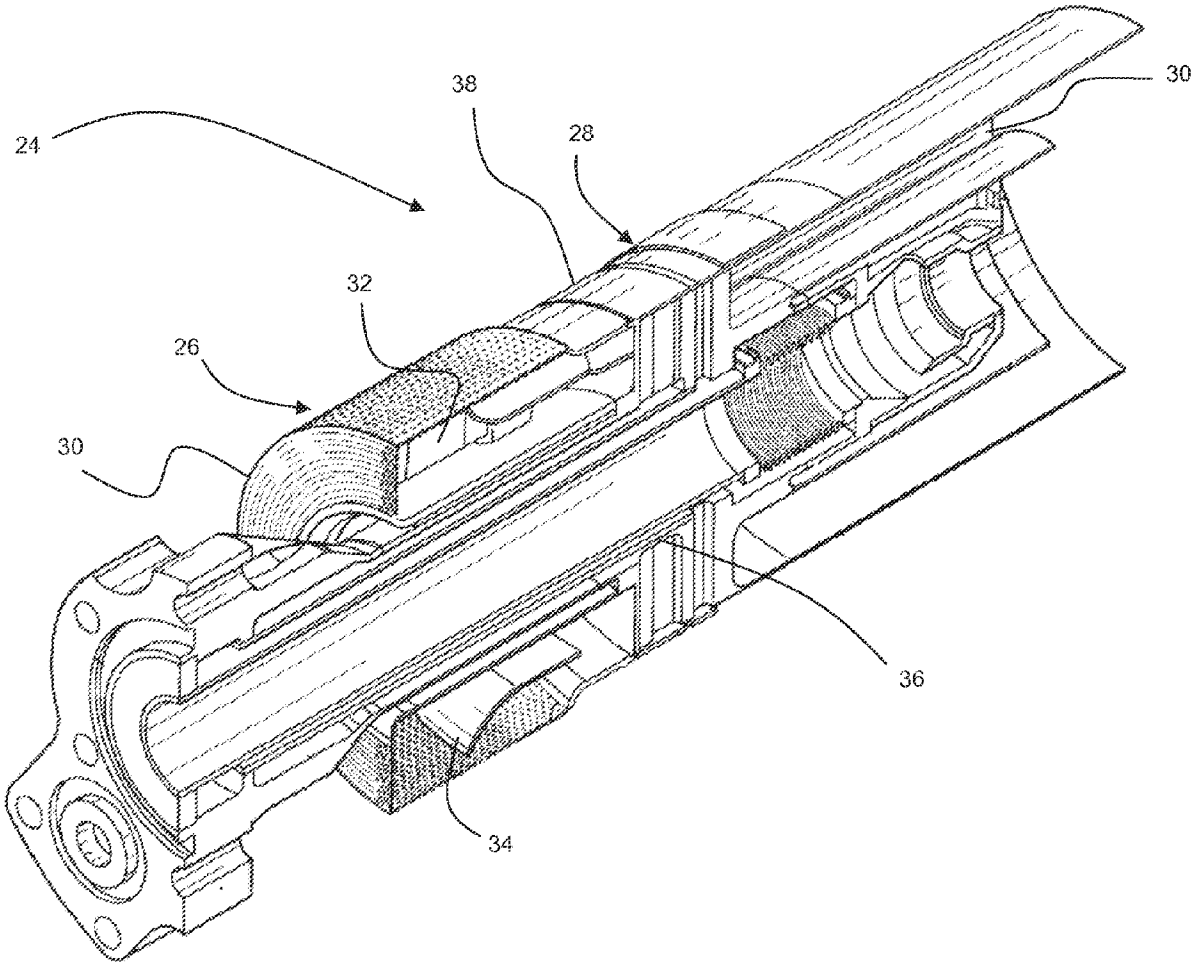
FIG. 2 is a perspective cross-section view of a burner according to one embodiment of the present invention.

FIG. 2 provides a perspective cross-section view of a burner 24 according to one embodiment of the present invention. In this embodiment, the burner 24 includes an inlet flow conditioner 26, a vortex stator assembly 28, and a mixed fuel passage 30.

The inlet flow conditioner 26 receives the compressed working fluid from the compressor 12 and prepares it for entry into the vortex stator assembly 28. The inlet flow conditioner 26 includes a perforated wall that forms an annular passage 32 through which the compressed working fluid passes. A flow guide 34 distributes the compressed working fluid radially before entry into the vortex stator assembly 28.

The vortex stator assembly 28 mixes fuel with the compressed working fluid and imparts a vortex swirl on the mixture. The vortex stator assembly 28 includes an inner shroud 36, an outer shroud 38, and a plurality of stator vanes 40. The inner 36 and outer 38 shrouds extend axially along a portion of the burner 24 to create an annular passage for the fuel and compressed working fluid. The inner shroud 36, outer shroud 38, and/or stator vanes 40 may include contoured walls or turbulators 42, such as dimples, ridges, or projections, to disrupt the laminar flow of the compressed working gas and improve mixing.

Figure 3:
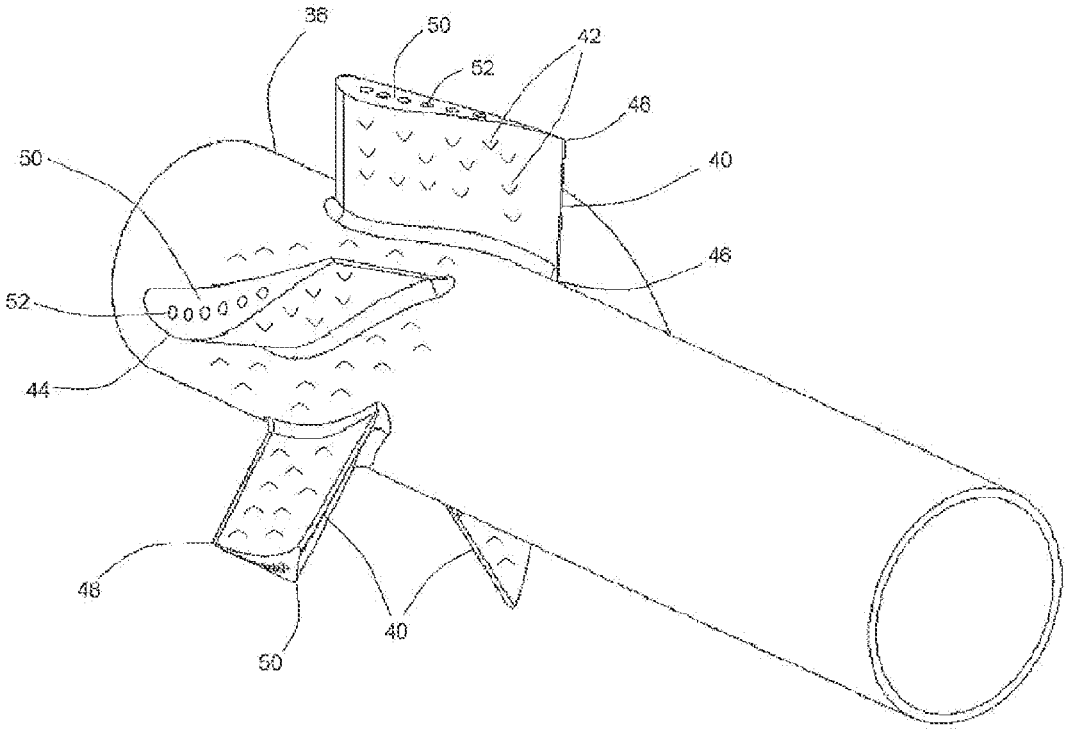
FIG. 3 is a perspective view of a portion of stator vanes according to one embodiment of the present invention.

FIG. 3 provides a perspective view of the stator vanes 40 according to one embodiment of the present invention. The stator vanes 40 have an airfoil shape 44 and are inclined to the direction of flow of the compressed working fluid so that as the compressed working fluid flows across the stator vanes 40, the stator vanes 40 cause the compressed working fluid to swirl or rotate around the inner shroud 36. For example, as the working fluid passes from left to right in FIG. 3, the stator vanes 40 cause the compressed working fluid to rotate clockwise, viewed from the bottom right of FIG. 3.

As shown in FIG. 3, the stator vanes 40 have an inner end 46 proximate the inner shroud 36 and an outer end 48 proximate the outer shroud (shown in FIG. 2 and omitted from FIG. 3 for clarity). The inner end 46 of each stator vane 40 connects to the inner shroud 36. The outer end 48 of each stator vane 40 includes a vortex tip 50 that creates a gap between the outer end 48 of each stator vane 40 and the outer shroud 38. The gap between the vortex tip 50 and the outer shroud 38 should be large enough to allow the compressed working fluid to pass between the vortex tip 50 and the outer shroud 38, but not so large as to unduly diminish the swirling imparted by the inclined stator vanes 40. A suitable gap may be 5-20% of the distance between the inner end 46 and the outer end 48. The stator vanes 40 may have a uniform size to produce uniform gaps. Alternatively, the stator vanes 40 may vary in their length or width, resulting in vortex tips at slightly different radii and non-uniform gap sizes.

The embodiment shown in FIG. 3 also includes fuel ports 52 at the vortex tip 50 to introduce fuel into the compressed working fluid. Additional fuel ports 52 may be included on either or both sides of the airfoil 44 of the stator vanes 40 to introduce additional fuel during surge or high power operations. Although the fuel ports 52 shown in FIG. 3 are circular in shape, the fuel ports may be of any geometric shape suitable for the particular fuel being used. For example, the fuel ports 52 may be triangular, rectangular, or curved. In addition, the fuel ports 52 may be directional so as to inject the fuel at a desired angle into the flow of the compressed working fluid.

The inclined stator vanes 40, airfoil surface 44, vortex tips 50, and fuel ports 52 combine to create a vortex swirl of the fuel and compressed working fluid mixture. That is, as fuel is injected into the flow of compressed working fluid, the inclined stator vanes 40 and airfoils 44 impart a swirling force on the fuel and compressed working fluid. At the same time, the vortex tips 50 create an additional vortex or eddy at the outer perimeter of the flow. The result is believed to produce improved mixing of the fuel and compressed working fluid, resulting in a more uniform mixture for combustion. In addition, the compressed working fluid typically flows over the stator vanes 40 at relatively high speeds of approximately 500 feet per second. Injection of the fuel into the flow of compressed working fluid as it flows over the stator vanes 40 reduces the risk known as flameholding in which the fuel prematurely ignites in the vicinity of the fuel ports 52 instead of in the combustion chamber 22.

Figure 4:
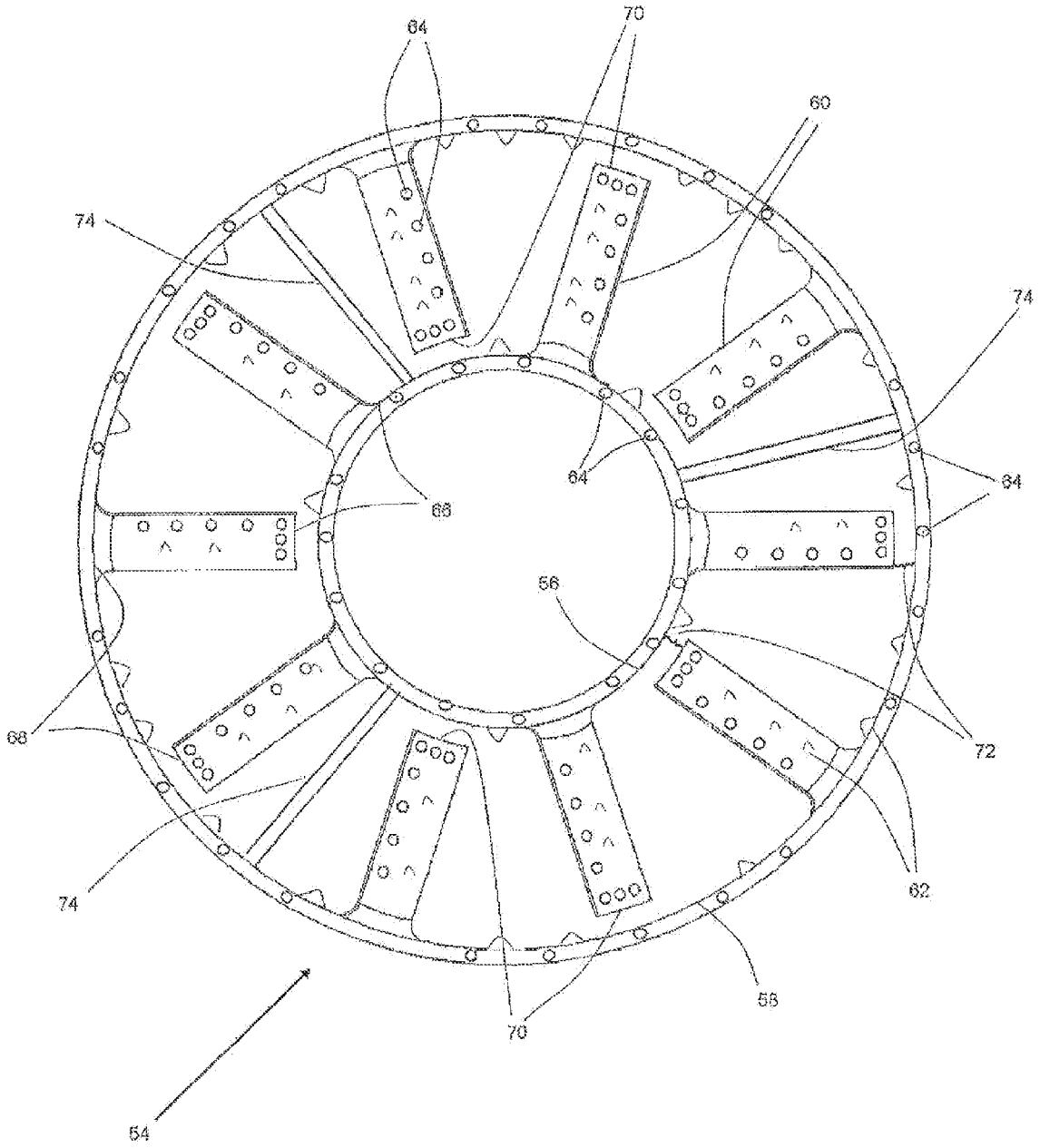
FIG. 4 is a plan view of a vortex stator assembly according to an alternate embodiment of the present invention.

FIG. 4 provides a plan view of a vortex stator assembly 54 according to an alternate embodiment of the present invention. The vortex stator assembly 54 again includes an inner shroud 56, an outer shroud 58, and a plurality of stator vanes 60. The inner 56 and outer 58 shrouds extend axially along a portion of the burner to create an annular passage for the fuel and compressed working fluid. The inner shroud 56, outer shroud 58, and/or stator vanes 60 may include contoured walls or turbulators 62, such as dimples, ridges, or projections, to disrupt the laminar flow of the compressed working gas and improve mixing. In addition, the inner shroud 56, outer shroud 58, and/or stator vanes 60 may include fuel ports 64 to introduce fuel into the swirling compressed working fluid. These fuel ports 64 may introduce additional fuel during surge or high power operations. Alternatively, the fuel ports 64 in the inner 56 and/or outer 58 shrouds may obviate the need for fuel ports 64 in the stator vanes 60, allowing the stator vanes 60 to be solid. Solid stator vanes are easier to manufacture and represent significant cost savings during construction.

The stator vanes 60 again are inclined to the direction of flow of the compressed working fluid so that as the compressed working fluid flows across the stator vanes 60, the stator vanes cause the compressed working fluid to swirl or rotate around the inner shroud 56. For example, as the working fluid passes down through the vortex stator assembly 54 shown in FIG. 4, the stator vanes 60 cause the compressed working fluid to rotate counter-clockwise, viewed from above FIG. 4.

As shown in FIG. 4, the stator vanes 60 again have an inner end 66 proximate the inner shroud 56 and an outer end 68 proximate the outer shroud 58. Each stator vane 60 includes a vortex tip 70 at either the inner end 66 or the outer end 68, in an alternating sequence, with the opposite end of the stator vane 60 connected to the proximate shroud 56, 58. As a result, the vortex tips 70 alternately create a gap 72 between either the inner end 66 and the inner shroud 56 or the outer end 68 and the outer shroud 58. The vortex tips 70 induce a vortex flow of the fuel and compressed working fluid alternately proximate to the inner shroud 56 and the outer shroud 58. The stator vanes 60 may have a uniform size to produce uniform gaps. Alternatively, the stator vanes 60 may vary in their length or width, resulting in vortex tips at slightly different radii and non-uniform gap sizes.

The vortex stator assembly 54 shown in FIG. 4 may further include struts 74 extending radially between and connected to the inner shroud 56 and the outer shroud 58. The struts 74 provide additional structural support between the inner 56 and outer 58 shrouds and may have an airfoil shape and be inclined, as with the stator vanes 60. In addition, the struts 74 may be hollow and include fuel ports to introduce fuel into the swirling compressed working fluid.

Figure 5:
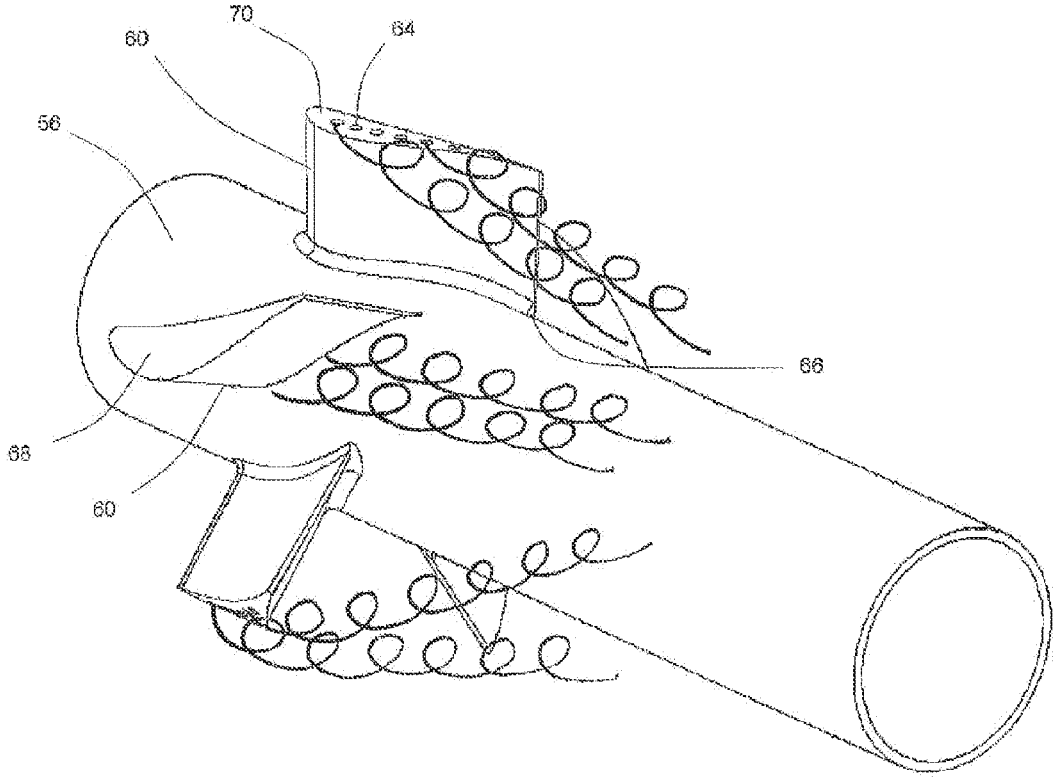
FIG. 5 is a perspective representation of the swirling vortex flow created by the vortex stator assembly shown in FIG. 4.

FIG. 5 provides a perspective representation of the swirling vortex flow created by the vortex stator assembly 54 shown in FIG. 4, with the outer shroud 58 removed for clarity. As shown, the vortex tips 70 include fuel ports 64. The fuel and compressed working fluid flow through the gap created between the vortex tips 70 and the respective inner 56 or outer 58 shroud to create a vortex swirling of the fuel and compressed working fluid mixture. This vortex swirling flow is in addition to the swirling flow of the fuel and compressed working fluid created by the inclined stator vanes 60.

One of ordinary skill in the art can appreciate variations of the illustrated embodiments may be combined to create still further embodiments within the scope of the present invention. For example, the location and number of vortex tips may vary, and the size of the gap created between the vortex tips and the inner or outer shroud may vary according to the particular design needs of the burner. In addition, the presence and location of fuel ports and turbulators on the inner shroud, outer shroud, and/or stator vanes may be different for each embodiment.

It should be appreciated by those skilled in the art that modifications and variations can be made to the embodiments of the invention set forth herein without departing from the scope and spirit of the invention as set forth in the appended claims and their equivalents.

What is claimed is:

1. A burner in a gas turbine, comprising:

a. an inner shroud extending axially along at least a portion of the burner;

b. an outer shroud radially separated from the inner shroud and extending axially along at least a portion of the burner;

c. a plurality of stator vanes located at an axial position extending radially between the inner shroud and the outer shroud, the plurality of stator vanes having an inner end proximate the inner shroud and an outer end proximate the outer shroud;

d. a fuel port on each of the plurality of stator vanes, the fuel port in fluid communication with a fuel plenum; and e. a plurality of vortex tips, the plurality of vortex tips portioned in alternating sequence on the inner end or the outer end of each adjacent stator vanes of the plurality of stator vanes, wherein a gap exists between each of the plurality of vortex tips and the outer shroud when those ones of the plurality of stator vanes are connected to the inner shroud and a gap exists between each of the plurality of vortex tips and the inner shroud when those ones of the plurality of stator vanes are connected to the outer shroud.

2. The burner of claim 1, wherein at least some of the plurality of stator vanes have different lengths.

3. The burner of claim 1, further including a fuel port in at least one of the inner shroud or the outer shroud.

4. The burner of claim 1, further including a plurality of struts extending radially between the inner shroud and the outer shroud and connected to the inner shroud and the outer shroud.

5. The burner of claim 1, further including a plurality of turbulators on at least one of the inner shroud, the outer shroud, or the plurality of stator vanes.

6. A gas turbine, comprising;

a. a compressor;

b. at least one combustor downstream from the compressor, wherein the at least one combustor includes a burner comprising:

i. an inner shroud extending axially along at least a portion of the burner;

ii. an outer shroud radially separated from the inner shroud and extending axially along at least a portion of the burner;

iii. plurality of stator varies located at an axial position extending radially between the inner shroud and the outer shroud, the plurality of stator vanes having an inner end proximate the inner shroud and an outer end proximate the outer shroud;

iv. a fuel port on each of the plurality of stator vanes, the fuel port in fluid communication with a fuel plenum; and v. a plurality of vortex tips, the plurality of vortex tips positioned in alternating sequence on the inner end or the other end of each adjacent stator vanes of the plurality of stator vanes, wherein a gap exists between each of the plurality of vortex tips and the outer shroud when those ones of the plurality of stator vanes are connected to the inner shroud and a gap exists between each of the plurality of vortex tips and the inner shroud when those ones of the plurality of stator vanes are connected to the outer shroud; and c. a turbine downstream from the at least one combustor.

7. The gas turbine of claim 6, wherein at least some of the plurality of stator vanes have different lengths.

8. The gas turbine of claim 6, further including a fuel port in at least one of the inner shroud or the outer shroud.

9. The gas turbine of claim 6, further including a plurality of struts extending radially between the inner shroud and the outer shroud and connected to the inner shroud and the outer shroud.

10. The gas turbine of claim 6, further including a plurality of turbulators on at least one of the inner shroud, the outer shroud, or the plurality of stator vanes.

* * * * *